United States Patent [19]

Chaisson

[11] Patent Number: 4,915,396

[45] Date of Patent: Apr. 10, 1990

[54] GRIPPING DEVICE FOR USE IN EXERCISING OR DANCING

[76] Inventor: Joseph L. Chaisson, 36 Ranee Avenue, Toronto, Ontario M6A 1M9, Canada

[21] Appl. No.: 332,437

[22] Filed: Mar. 31, 1989

Related U.S. Application Data

[63] Continuation of Ser. No. 163,579, Mar. 3, 1988, abandoned.

[30] Foreign Application Priority Data

Mar. 5, 1987 [CA] Canada ..... 531209

[51] Int. Cl.[4] ..... A63B 21/00

[52] U.S. Cl. ..... 272/93

[58] Field of Search ..... 272/67, 68, 78, 93, 272/124, 125, 126, 131, 132, 137, 140, 143, 74, 75, 76; 403/56; 16/110 R, 121, 122, 123

[56] References Cited

U.S. PATENT DOCUMENTS

| | | | |
|---|---|---|---|
| 112,816 | 3/1871 | Kintz | 16/123 |
| 148,893 | 3/1874 | McClellan | 16/123 |
| 175,025 | 3/1876 | Burns | 16/123 |
| 569,436 | 10/1896 | Spurr | 403/56 X |
| 786,318 | 4/1905 | Shepherd | 272/68 |
| 1,528,967 | 3/1925 | Bersted | 403/56 X |
| 2,719,038 | 9/1955 | Massa | 272/75 |
| 3,054,275 | 9/1962 | Ongaro | 403/56 X |
| 3,180,604 | 4/1965 | Hammer | 403/56 X |
| 3,248,311 | 4/1966 | Mitchell | 272/132 X |
| 3,323,796 | 6/1967 | Carlson . | |
| 3,454,274 | 7/1969 | Kanishiro | 272/76 |
| 3,588,102 | 6/1971 | Gifford | 272/67 X |
| 3,782,721 | 1/1974 | Passera | 272/132 |
| 3,958,803 | 5/1976 | Geisselbrecht | 272/140 X |
| 4,060,241 | 11/1977 | Hegel | 272/132 |
| 4,186,920 | 2/1980 | Fiore et al. | 272/132 X |
| 4,199,137 | 4/1980 | Giguere | 272/132 X |
| 4,249,727 | 2/1981 | Dehan | 272/143 X |
| 4,293,125 | 10/1981 | Hinds | 272/75 |
| 4,438,612 | 3/1984 | Bernard et al. | 403/56 X |
| 4,585,363 | 4/1986 | McGoire | 272/67 X |
| 4,593,901 | 6/1986 | Moore et al. | 272/78 |
| 4,603,856 | 8/1986 | Fiore | 272/131 |

FOREIGN PATENT DOCUMENTS

| | | | |
|---|---|---|---|
| 3008990 | 9/1980 | Fed. Rep. of Germany | 403/56 |
| 249403 | 7/1926 | Italy | 403/56 |
| 1237225 | 6/1986 | U.S.S.R. | 272/132 |

*Primary Examiner*—Richard J. Apley
*Assistant Examiner*—Robert W. Bahr
*Attorney, Agent, or Firm*—Rogers, Berskin & Parr

[57] ABSTRACT

A hand held device is provided for use in exercising and dancing. The device has two handles, a different one of which is grasped by each dance or exercise partner during use. A connecting strut extends between the handles. The device also has a swivel to permit relative rotation of the handles. An swivel connection is achieved through use of ball type joints. The swivel connection may also permit tilting of the handle with respect to the strut. This device can be used in conjunction with most body movements, such as dancing or exercising, simply by holding the swivelling handles of the device instead of holding hands, with the minimum risk of injury to the users, thus giving a new approach to the performance of dancing and exercising whether it be recreational or professional.

6 Claims, 1 Drawing Sheet

GRIPPING DEVICE FOR USE IN EXERCISING OR DANCING

This application is a continuation of Ser. No. 169,579, filed Mar. 3, 1988, now abandoned.

SUMMARY OF THE INVENTION

This invention relates to a device to be used for exercising or dancing.

In various forms of dancing, and in particular square dancing, there are intricate moves whereby partners hold one another by the hand and conduct various spinning and turning movements. This device provides a suitable gripping function for each of the two partners involved in the dance while permitting the full freedom necessary to conduct the typical spinning and turning manoeuvres required by the dance.

Typically, when involved in dancing or exercising the partners hold hands. At a time when the hands are used to pull one partner toward the other a grip is necessary between the two pratners hands. At other times when a partner is being spun, the hands are joined together but a new or differing grip must be utilized to permit the hands to turn, one with respect to the other. During such manoeuvres it is frequently possible that the partners loose their grip thus upsetting the balance of one or the other of the partners.

According to this invention there is provided a very simple device which provides a means for the partners to maintain a grip while still permitting all of the required dance movements. The device comprises first and second handles which are adapted to be grasped by the partners during use. There is an elongate strut extending between the two handles. The device further includes swivel means which are located to enable the first handle to rotate with respect to the second handle to permit spinning movements by the partners.

In a particularly preferred embodiment of the invention, the handles comprise relatively small surfaces which can be gripped by two fingers. A strut extends between the handles and comprises a ball joint which permits the handles to rotate one with respect to the other. In another particularly preferred embodiment, the strut comprises two ball-like ends each of which is adapted to be received within a mating socket within each of the handles.

BRIEF DESCRIPTION OF THE DRAWINGS

The invention will be more clearly understood with reference to the attached drawings which illustrate various preferred embodiments of the invention, and in which.

DESCRIPTION OF THE PREFERRED EMBODIMENTS

Figure 1:
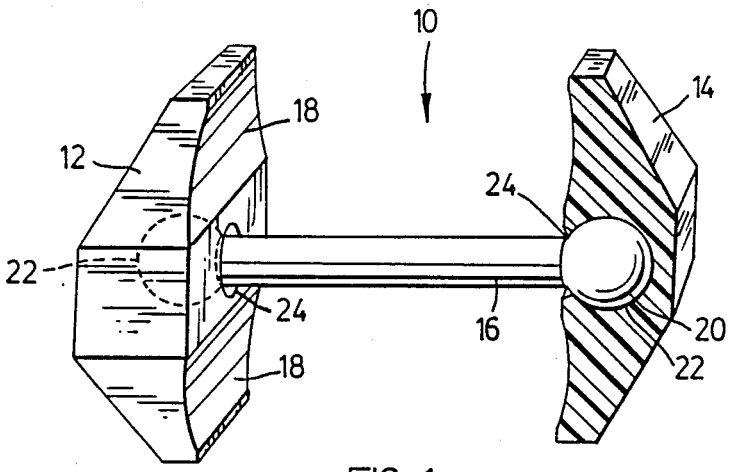
FIG. 1 is an isometric view of a first embodiment of the invention with one of the handles being broken away and shown in section.

In the preferred embodiment illustrated in FIG. 1, the device 10 comprises a first handle 12 and a second handle 14. Extending between the two handles is a strut 16. The handle 12 shown in full lines advantageously comprises two surfaces 18 which may be gripped by the fingers of one of the dancing or exercising partners. The remainder of the body of the handle 12 is sized to fit comfortably within the palm of the dancer.

The handle 14 is illustrated in FIG. 1 in section to show the internal cavity of the handle. The handle 14 comprises a generally spherical internal cavity 20. The handle 12 also comprises a similar internal cavity. The strut 16 has first and second ends. Each of the ends has the configuration of a portion of a ball or sphere 22. The sphere 22 is visible within the sectioned handle 14 and is shown in dotted outline within handle 12.

The configuration of the internal cavity of each of the two handles is such that the handle comprises an annular clearance indicated by the numeral 24 which provides clearance between the handle and the strut 16. The clearance 24 provides for tilting movement of each of the handles with respect to the strut, thus allowing for an additional degree of freedom between the two handles. Advantageously sufficient clearance is provided that the handle can tip approximately 15° with respect to the strut. Tipping movement of this magnitude is illustrated in respect of a similar handle 12 shown in FIG. 2.

Figure 2:
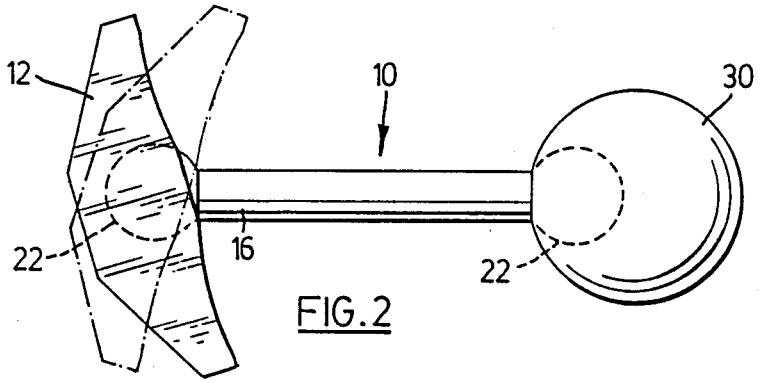
FIG. 2 is a front view of a second embodiment of the invention.

The embodiment shown in FIG. 2 is substantially similar to that shown in FIG. 1. The device 10 comprises a first handle 12 and a strut 16. The strut 16 comprises ball-like ends 22 which are accommodated within the handles. The device illustrated in FIG. 2 differs from that illustrated in FIG. 1 in that the device comprises a handle 30 which has a different configuration from the handles 12 and 14. By permitting different configuration of the handles different movements for the partners can be easily accommodated. Also where the partners have different finger strengths or hand sizes or where movement of the hand may be impaired or affected by arthritis or the like, it is advantageous to provide differently shaped handles to accommodate these various conditions. Except for the configuration difference in the handles, the device shown in FIG. 2 is substantially similar to that shown in FIG. 1. Handles having various other configurations and sizes may be employed.

Figure 3:
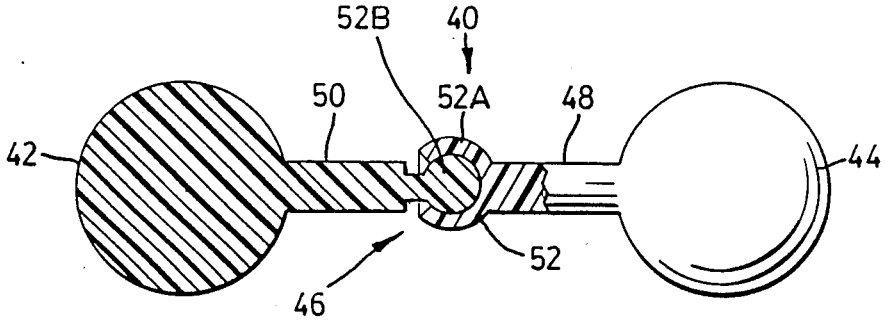
FIG. 3 is a front view of a third embodiment of the invention in which one of the handles is shown in section.

The embodiment 40 illustrated in FIG. 3 comprises a first handle 42 and a second handle 44. There is a strut 46 extending between the handles 42 and 44. The strut 46 comprises a first portion 48 and a second portion 50. The strut 46 also comprises a ball and socket joint 52. One portion of the strut 48 is shown in full lines and comprises a socket 52A which accommodates a ball 52B which is included on one end of the portion 50 illustrated in section in FIG. 3. The ends of the portions 48 and 50 distal to the ball and socket joint are affixed to the handles 42 and 44.

It will be observed that in all embodiments illustrated the handles may rotate in an unlimited number of rotations with respect to each other. Thus, the partners may twirl through any number of degrees of turning with respect to each other while continuing to grasp the handle tightly. In all of the embodiments there is some tilting movement available in view of clearance of the ball and socket joints to permit freedom of the dance movements.

A particularly advantageous material for construction of the device is polyethylene which is a tough thermoplastic resin. The handles for the device may be manufactured in molds with each handle being manufactured in two halves. The two halves may be placed together over the ball-like ends of the strut and then welded by conventional means such as sonic welding or the like. In respect of the embodiment illustrated in FIG. 3, a portion of the device comprising the socket for the ball can advantageously be manufactured in split halves for assembly in a similar fashion. In all cases the "ball" for the ball and socket joint need not be a full spherical portion. A segment of a sphere is sufficient. It will be appreciated that while a ball and socket swivel means is preferred, various other types of swivel joint may be utilized.

While specific configurations and materials have been discussed in connection with the preferred embodiments it will be apparent that changes, modifications and adaptations can be made therein without departing from the spirit of the invention as defined in the appended claims.

I claim:

1. An exercising or dancing device comprising:

first and second graspable handles;

an elongate strut extending between said first and second handles;

said device having swivel means for enabling said first handle to rotate unlimitedly with respect to said second handle; and, at least one of said handles having a first surface extending generally laterally of said strut and a second surface generally opposite to said first surface, said first surface extending on generally opposite sides of said strut and said second surface being spaced from said first surface and generally convex relative thereto wherein said handle may be grasped by a human hand with the palm of the hand against said second surface and at least one finger against said first surface on each of said opposite sides of said strut.

2. The device of claim 1 in which said swivel means comprises at least one ball and socket joint.

3. The device of claim 2 in which at least one of said handles comprises a socket and said strut includes a ball for receipt in said socket.

4. The device of claim 3 in which at least said one of said handles is affixed to said strut to enable tilting movement with respect to said strut and rotary movement with respect to said strut.

5. The device of claim 2 in which said swivel means comprises at least two ball and socket joints.

6. The device of claim 5 in which said strut comprises first and second ends, each end having a ball configuration, and each of said handles includes a socket to accommodate one end of said strut.

* * * * *